United States Patent [19]

Sase et al.

[11] Patent Number: 5,004,068

[45] Date of Patent: Apr. 2, 1991

[54] MUFFLER

[75] Inventors: Toshitsugu Sase, Kanagawa; Michiaki Matsuda, Tokyo; Kiyoshi Yanagisawa; Mitsuru Maeda, both of Kanagawa, all of Japan

[73] Assignee: Ebara Corporation, Tokyo, Japan

[21] Appl. No.: 446,766

[22] Filed: Dec. 6, 1989

[30] Foreign Application Priority Data

Dec. 6, 1988 [JP] Japan ..... 63-306950

[51] Int. Cl.[5] ..... F01N 1/02

[52] U.S. Cl. ..... 181/276; 181/272; 181/282

[58] Field of Search ..... 181/247-256, 181/269, 273, 272, 282, 276

[56] References Cited

U.S. PATENT DOCUMENTS 1,638,309 8/1927 Kemble .
1,844,105 2/1932 Schnell ..... 181/252
2,088,576 8/1987 Compo .
2,185,584 1/1940 Boyce ..... 181/252 X
2,512,155 6/1950 Hill ..... 181/249
3,080,940 3/1963 Jobson .

FOREIGN PATENT DOCUMENTS 918597 2/1947 France .
1441401 5/1966 France .

OTHER PUBLICATIONS

"Acoustic Performance of Low-Aspect-Ratio Muffler", K. Yasui Lecturing Paper (pp. 357-360), Japan Noise Control Technology Association, 9/86.

*Primary Examiner*—Benjamin R. Fuller
*Attorney, Agent, or Firm*—Wenderoth, Lind & Ponack

[57] ABSTRACT

A muffler is constructed to have a tubular perforated plate within its cavity so as to divide the cavity into an outer resonant cavity and an inner resonant cavity, to thereby provide two resonant frequencies. The tubular perforated plate is formed in the shape of a funnel.

4 Claims, 2 Drawing Sheets

MUFFLER

TECHNICAL FIELD

The present invention relates to a muffler and more particularly to a resonant type muffler.

BACKGROUND OF THE INVENTION

In order to attenuate noise, a muffler is employed and its type is generally classified as a sound absorbing type or a resonant type, etc. A sound absorbing type muffler is provided with a sound absorbing material filled within a muffler tube. Glass fiber, rock wool or mineral wool is selected for a tube filling. However, these materials cannot be used in a sound absorbing type muffler if pollution due to a sound absorbing material is to be avoided.

On the other hand, in the case of a resonant type muffler, attenuation of sound may be insufficient if the dimension of the muffler in the fluid flowing direction is such that it restricts the length of its resonant cavity. Also, in the conventional resonant type mufflers, attenuation can only be effected within only a narrow frequency band due to the provision of a single resonant cavity.

SUMMARY OF THE INVENTION

Accordingly, it is an object of the present invention to provide a resonant type muffler, which can effectively attenuate sound over a wide frequency band.

The above object is accomplished by a muffler constructed according to the present invention. According to the present invention, a muffler is constructed to have a tubular perforated plate within a cavity of a barrel which is formed in the shape of a funnel and is in communication with inlet and outlet tubes of the muffler. The tubular plate divides the cavity into an outer resonant cavity and an inner resonant cavity so that the muffler possesses two resonant frequencies and attenuation is effected over a relatively wide frequency band.

Further details will be given in the detailed description of the embodiment following the explanation of the drawings given below.

DETAILED DESCRIPTION OF THE PREFERRED EMBODIMENT

Figure 1:
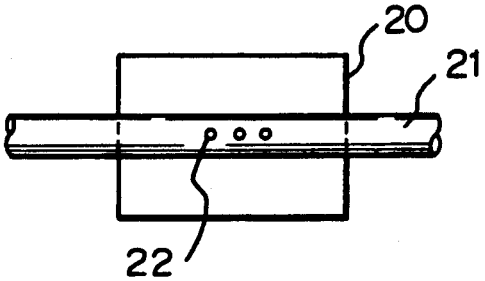
Fig. 1 PRIOR ART
FIG. 1 schematically shows an example of a conventional muffler.

Before explaining the present invention, a conventional resonant type muffler will briefly be explained referring to FIG. 1.

An example of a conventional resonant type muffler is shown in FIG. 1 and comprises a cylindrical or square column cavity 20 and a tube 21 extending through the cavity 20. Within the cavity 20, the tube 21 is provided with multiple perforations 22 in the wall thereof so that the tube 21 constitutes a perforated plate within the cavity. In this type of muffler, if a sufficient length of the muffler in the fluid flowing direction is not present within the cavity, the surface area of the perforated plate is small, such that the sound attenuation is insufficient. Also, in the construction of a conventional muffler, there is only a single resonant cavity. Thus, attenuation is limited to a narrow frequency band around the resonant frequency.

Figure 2:
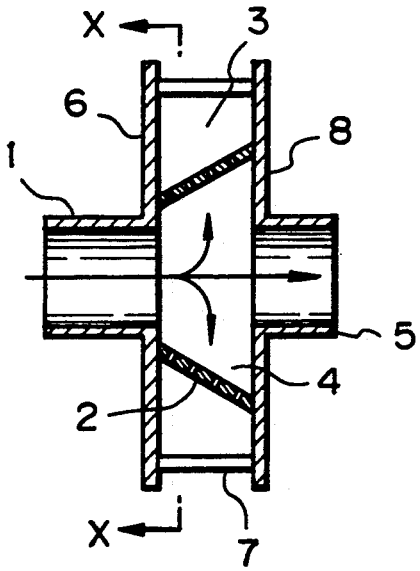
FIG. 2 is a drawing showing a longitudinal sectional view of an embodiment according to the present invention.
Figure 3:
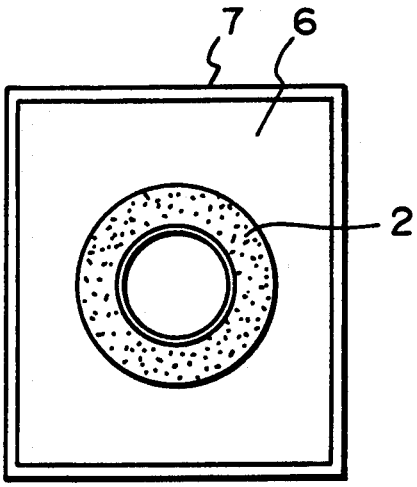
FIG. 3 is a cross sectional view taken along the line X—X in FIG. 2.
Figure 5:
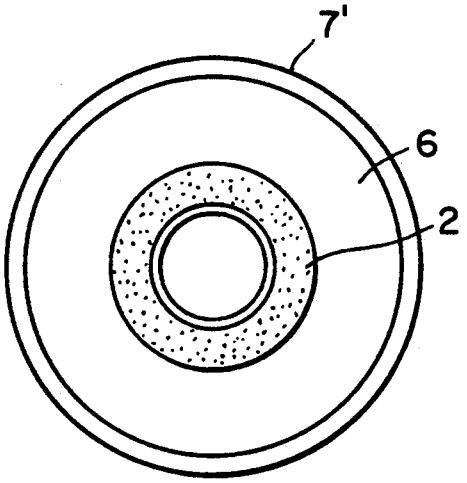
FIG. 5 is a cross sectional view similar to FIG. 3, but showing a different embodiment.

Now, referring to FIGS. 2 and 3, a muffler according to the present invention is shown schematically. In the drawings, numeral 7 designates an outer barrel which in this embodiment is shown as a square column type. However, the muffler may be in the form of a cylinder 7′ (as shown in FIG. 5). A cavity is defined within the barrel 7, 7′ by side plates 6, 8 and the barrel 7, 7′. To the side plates 6 and 8, an intake tube 1 and an outlet tube 5 are attached, respectively. Within the barrel 7, 7′ a perforated plate 2 is installed. The plate 2 is formed in a cylindrical shape which expands from the side of the inlet tube 1 towards the side of the outlet tube 5 in a manner resembling a funnel shape. The minimum cross sectional area of the perforated plate 2 relative to the fluid flowing direction is equivalent to, or more than, that of the intake tube and the maximum cross sectional area thereof is arranged to be larger than that of the outlet tube. It is to be noted that the direction of expansion of the perforation plate 2 may be opposite to that shown in FIG. 2. By the tubular perforated plate 2, the cavity of the barrel 7, 7′ is divided into an outer resonant cavity 3 and an inner resonant cavity 4.

Figure 4:
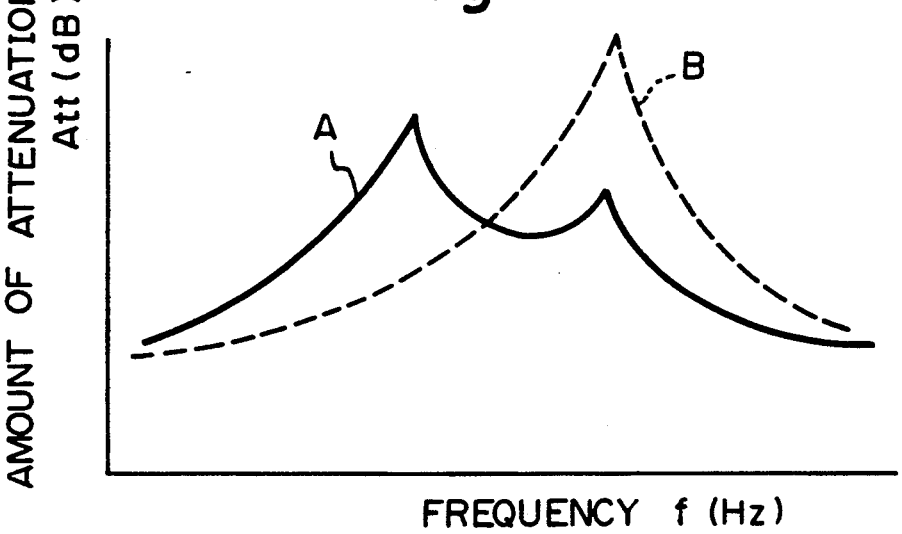
FIG. 4 is a graph showing a comparison of the attenuation provided a muffler according to the present invention and that provided by a conventional muffler.

In the muffler constructed as above, a sound wave entering from the inlet tube 1 passes through the perforated plate 2 and propagates within the resonant cavity 3 wherein it is attenuated by resonance in the cavity 3. Further, the sound wave also causes resonance in the resonant cavity 4 and is attenuated. This muffler, thus, possesses two kinds of resonant cavities and has a resonant frequency at two points as indicated by the curve A (solid line) in FIG. 4. In FIG. 4, the curve B (dotted line) represents a conventional muffler which has only resonant frequency. So, in the conventional muffler, attenuation is effected only around this one resonant frequency. However, in the muffler according to the present invention, attenuation is effected in a relatively wide frequency band around the two resonant frequencies whereby attenuation is greatly enhanced compared to attenuation provided by a conventional muffler.

What is claimed is:

1. A muffler comprising:

a barrel having first and second side plates mounted to opposing ends thereof to form a substantially enclosed cavity;

an inlet tube attached to said first side plate and communicating with said substantially enclosed cavity;

an outlet tube attached to said second side plate and communicating with said substantially enclosed cavity;

a perforated tube mounted within said substantially enclosed cavity and having a first end connected to said first side plate in direct fluid communication with said inlet tube and a second end connected to said second side plate in direct fluid communication with said outlet tube, said perforated tube having substantially a funnel shape, one of said first and second ends of said perforated tube having an inside diameter which is greater than or equal to an inside diameter of said inlet tube and greater than or equal to an inside diameter of said outlet tube, another of said first and second ends of said perforated tube having an inside diameter which is greater than said inside diameter of said inlet tube, greater than said inside diameter of said outlet tube and greater than said inside diameter of said one of said first and second ends of said perforated tube, said perforated tube dividing said substantially enclosed cavity into an inner resonance cavity which is substantially void of sound absorbing material and an outer resonance cavity which is substantially void of sound absorbing material.

2. A muffler as recited in claim 1, wherein said one of said first and second ends of said perforated tube comprises said first end of said perforated tube.

3. A muffler as recited in claim 1, wherein said barrel has a circular cross section.

4. A muffler as recited in claim 1, wherein said barrel has a rectangular cross section.

* * * * *